United States Patent [19]

Thomas

[11] Patent Number: 5,006,680

[45] Date of Patent: Apr. 9, 1991

[54] SNAP ACTION SWITCH

[75] Inventor: Joseph Thomas, Reading, Mass.

[73] Assignee: Augat, Inc., North Andover, Mass.

[21] Appl. No.: 348,032

[22] Filed: May 5, 1989

[51] Int. Cl.[5] ..... H01H 11/00

[52] U.S. Cl. ..... 200/293; 200/343; 200/461; 29/622

[58] Field of Search ..... 200/461, 460, 459, 408, 200/409, 343, 293, 303; 29/622

[56] References Cited

U.S. PATENT DOCUMENTS

| | | | |
|---|---|---|---|
| 3,144,529 | 8/1964 | Zemke et al. | 200/461 |
| 3,513,274 | 5/1970 | Jullien-Davin | 200/461 |
| 4,044,212 | 8/1977 | Takano | 200/461 X |
| 4,070,555 | 1/1978 | Carli | 200/303 |
| 4,644,115 | 2/1987 | Nishimori et al. | 200/409 |

FOREIGN PATENT DOCUMENTS

| | | | |
|---|---|---|---|
| 2459464 | 6/1975 | Fed. Rep. of Germany | 200/343 |

*Primary Examiner*—Renee S. Luebke

*Attorney, Agent, or Firm*—Pearson & Pearson

[57] ABSTRACT

A snap action switch including a switch in incipient form. The switch comprises a contact having a cut-out tongue mounted on a post with the tongue bent to form a spring, the post being one terminal. The other end of the element remote from the tongue end initially contacts an exposed second or third terminal above or below the other end. When an actuator or nose from a resilient body acts against the surround adjacent the tongue end, force is exerted against the contact. The contact snaps from the initial connection between the nose and one of the second or third contacts to the other. When the resilient body relaxes, the nose resumes its original position and the switch snaps back to resume a connection between the post and the initial connection with the second or third terminal.

31 Claims, 1 Drawing Sheet

Fig. 1
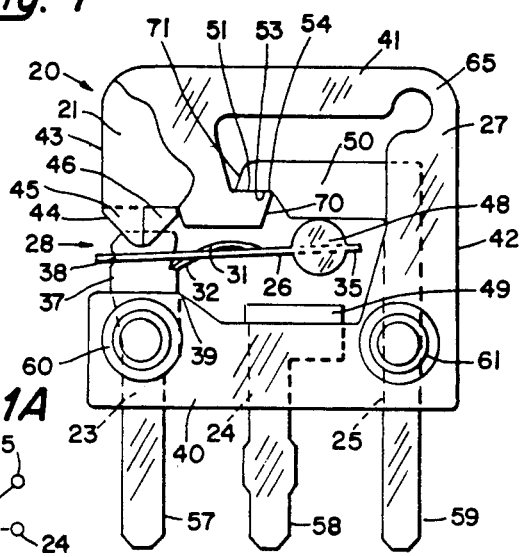
Fig. 2
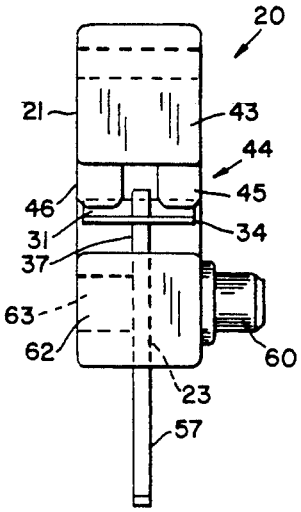
Fig. 1A
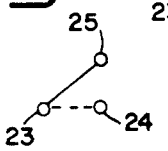
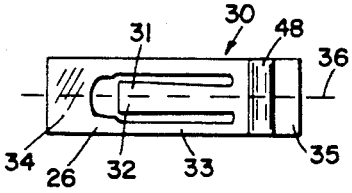
Fig. 3
Fig. 4
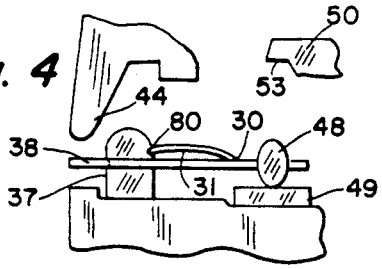
Fig. 5
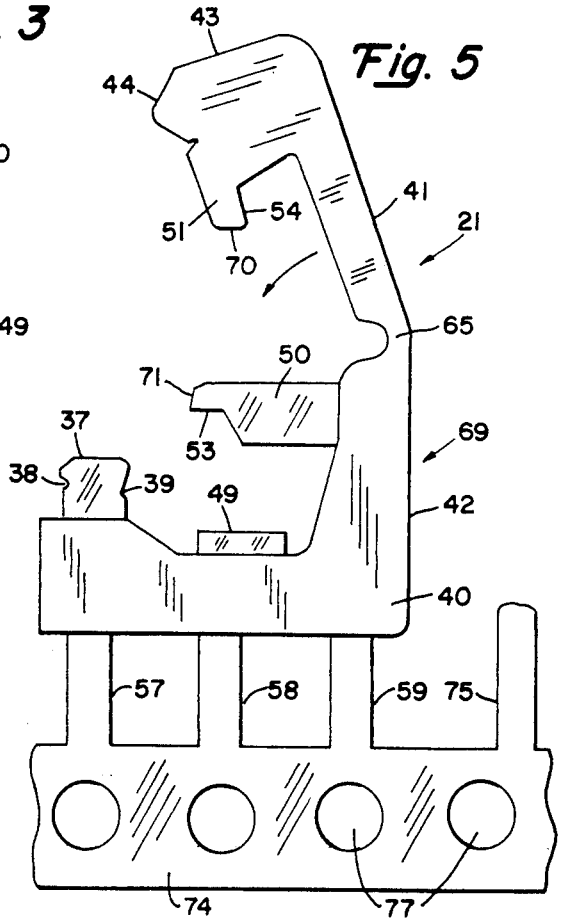
Fig. 6
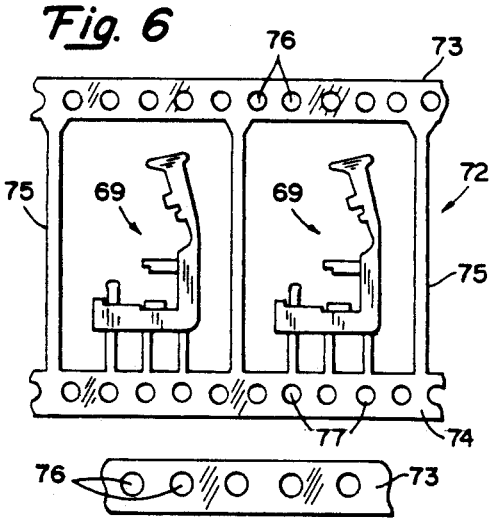

SNAP ACTION SWITCH

FIELD OF THE INVENTION

The invention relates to switches, and more particularly to miniature precision snap action switches.

BACKGROUND OF THE INVENTION

Various patents describe snap action switches.

For example U.S. Pat. No. 3,648,004 to Williams, III, Mar. 7, 1972, for Auxiliary Support Means for Electrical Switch Actuator describes a snap action switch biased to a first position. By depression of a plunger, the switch is actuated to a second position.

U.S. Pat. No. 3,700,843 to Resh, Oct. 24, 1972, for snap-in Rigid Lever Actuating Arrangement, describes a rigid lever actuator which is snap fastened into place on an electrical switch base.

U.S. Pat. No. 3,809,837 to Yoshioka May 7, 1974, for Microswitch with Readily Removable Leaf Spring Actuating Means, describes a push button switch including an actuator. One portion of a spring is formed into a hook which engages a presented edge on the corresponding wall of a recess. This edge is preferably sharp to provide a fulcrum for bodily rocking movement of the actuator.

U.S. Pat. No. 3,811,024 to Sevigny May 14, 1974, Monetary Contact, Non-Bounce Switch describes a switch means carrying a weighted contact which may be biased away, is allowed to snap back to make a momentary electrical contact.

U.S. Pat. No. 3,832,508 to Beck, Aug. 27, 1974, for Micro-lever Switch Operator describes a lever which includes a portion for engagement with the operating plunger and a mounting portion having a forked extension with pivot arms.

U.S. Pat. No. 4,117,284 to Kirchoff et al. Sept. 26, 1978, describes a three position switch having a rocker, or see-saw movable contact.

U.S. Pat. No. 4,191,387 to Kirchoff for Watertight Seal for Toggle Switches, Mar. 4, 1980, relates to the seal for a toggle switch.

U.S. Pat. No. 4,254,310 to Kirchoff et al., Mar. 3, 1981, for Subminiature Multi-pole Toggle Switch with Linear See-saw Contact, shows a toggle switch reaching stable positions by virtue of a compression spring.

U.S. Pat. No. 4,295,017 to Kashima et al. Oct. 13, 1981, for Limit Switch describes an actuating arm 141 that is operated about a fulcrum to actuate a push button of a switch. A spring returns the lever to its normal position after actuation.

U.S. Pat. No. 4,306,132 to Henville, Dec. 15, 1981, for Electrical Switches describes a switch with an actuating lever for pivotal movement to actuate the switch.

U.S. Pat. No. 4,362,916 to Anderson, Dec. 7, 1982, for Miniature Precision Snap Action Switch Having Operating Lever Providing Large Overtravel uses one end 14*a* of a coiled bias spring 14 to bear against a bracket. The other end 14*b* is held against the riveted end of a cam 16 to bias the lever arm 12 and cam 16 counterclockwise until the tip 16*e* stops against the upper surface of a strip 8*c*.

U.S. Pat. No. 4,394,553 to Foil, July 19, 1983, describes a snap-action switch using a contact "trap mounted" to a terminal bracket. A lever may exert force on the spring to cause it to assume its other position. The spring contact returns when the lever is released.

SUMMARY OF THE INVENTION

According to the invention, in a snap action switch a planar metallic body has a movable contact with a cutout tongue and a complete surround. The movable contact is mounted on a vertical conductive post with the post inserted between the tongue end and the surround end adjacent the tongue end to bend the tongue into a spring. A resilient insulating body holds two terminals, one above the other end of the element and the other below the other end of the element. The body has a nose which may be pressed against the surround adjacent the tongue end. When a force overcomes the resilience of the body to bring the nose down against the surround tongue end, the other member end is snapped from one terminal to the other terminal, breaking an initial connection from the post to the one, and making a connection from the post to the other. When the force is released, the initial connection is re-established.

In another aspect according to the invention, the resilient body includes an incomplete loop, which may have a lower or base side, an upper or cover side, and a third side as complete loop sections, and another, incomplete side. The resilient body has the upper or cover side latched to the complete side to retain the loop configuration. The post faces along the incomplete side toward the nose, also on the incomplete side. The element makes contact between the post and between one of the contacts held by the body.

In another aspect according to the invention, the invention also includes an incipient form of the snap action switch which comprises a unitary integral body having a lower section and a side section, the side section being jointed to the lower section at a corner. When the corner is bent to bring an end part of the side section parallel the base section to form the cover section, the side section and the cover section are latched to form the switch.

In still another aspect according to the invention, the incipient snap action switch is made by processing forms in sequence between two parallel conductive strips, from which the contacts of the switch are developed.

DESCRIPTION OF THE DRAWINGS

The various objects, advantages, and novel features of the invention will be more fully apparent from the following detailed description when read in connection with the accompanying drawings, in which like reference numerals refer to like parts and in which:

FIG. 1 is a side view of an embodiment of the invention;

FIG. 1*a* is a small schematic electrical diagram of the operation of this switch;

FIG. 2 is a front view of the embodiment of FIG. 1;

FIG. 3 is a top view of the movable contact;

FIG. 4 is a partial side view of another embodiment of the invention;

FIG. 5 is a side view of an incipient switch form under construction useful in explaining how the switch is made; and FIG. 6 is a side view of several of the switches of FIG. 5 under construction further useful in explaining how the switch is made.

DETAILED DESCRIPTION OF THE PREFERRED EMBODIMENT

Referring to FIGS. 1-3, a snap action switch 20 comprises a unitary resilient insulating body or housing 21 having imbedded first, second and third terminals 23, 24, and 25, respectively. The body 21 is formed into a loop 27 incomplete at a gap 28, the resilience of the body 21 tending to open the loop 27 further at the gap 28.

A metallic member 30 may comprise a movable contact 26 and has a cut-out tongue 31 which has an end 32 and a surround 33. The member 30 has one longitudinal axial end 34 adjacent the tongue end 32 and another, axial, action free terminal end 35 at the other longitudinal axial end of the member 30 along the longitudinal axis 36. The longitudinal end 34, adjacent the tongue end 32 engages a post 37 which is an exposed vertical extension up from the first terminal 23. The post 37 is inserted in the space between the end 32, of the tongue and the longitudinal axial end 34. So forcing the tongue 31 upon the post 37 causes the tongue 31 to bend into a spring, indicated also by the numeral 31. In order to definitely locate the tongue 31 on the post 37, the post is provided with a notch 38 on the outside of the post 37 with respect to the loop 27 which provides a fulcrum for the member 30, and a lower, inner notch 39 on the inside of the loop 27, so that the surround 33 lodges in the outer notch 38 to provide the fulcrum and the tongue end 32 lodges in the inner notch 39 to provide a force holding the spring 31 in bowed condition.

The loop 27 comprises a lower or base section 40, an upper or cover section 41 and two side sections, one complete side section 42 and an incomplete side section 43. A nose contact 44 on the incomplete side section 43 extends from the upper section 41 toward the lower section 40 and toward the member end 34. The actuator or nose 44 may be constructed in two parts 45, 46, so that when it presses down against the member end 34 adjacent the tongue 31, it exerts force equally and symmetrically on each side of the axis 36 and avoids the post 37, as shown in FIG. 2.

The metallic member 30 may include a cylindrical contact element 48 at the other, action end 35 of its longitudinal axis. The cylindrical element 48 has a horizontal axis parallel to the plane of the member 30, which is essentially planar. Although the form of the cylindrical element 48 is presently a preferred form, any contact element may be used, preferably of enough mass to provide a good "throw" to make a good contact as the element responds to the "snap" action, and if possible without "bounce". The second terminal 24 extends exposed at 49 from the body 21 lower section 40 below the action end 35, and the third terminal is exposed as a bar 50 cantilevered from the complete side section 42 inwardly of the loop 27 and toward the incomplete side 43 above the action end 35, of the member 30. A probe 51 from the upper part of the incomplete side section 43 latches with the bar 50 from the complete side section 42, the surfaces 53 and 54 affording the latching surfaces from bar 50 and probe 51 respectively.

The three terminals 23, 24, and 25, are connected respectively to three aligned connections 57, 58 and 59 which exit vertically respectively from below the body 21. A plurality of the switches 20 may be closely stacked horizontally and closely supported physically by means of horizontal exposed connections 60 and 61 respectively to terminals 23 and 25, brought out at the lower part of the body 21. Further the exposed horizontal connections 60 and 61 may mate respectively with openings 62 and 63,(concealed behind 62 in FIG. 2) so that these terminals may be connected in parallel with the corresponding terminals of an adjacent switch, and at the same time afford physical support. If one wishes, the horizontal external connections 61 may be omitted and for example, the connections 60 may be retained as a ground connection, or as a power connection, or the other connection 61 may be retained as a ground connection omitting exposed connection 60.

A reduced thickness annular corner 65 between the complete, vertical side section 42 and the upper or cover section 41 lends to the body 21, the resilience tending to swing the upper section 41 clockwise about the corner 65. This swing is restrained by the latch formed between the bar 50 and the probe 51 afforded by their respective latching surfaces 53 and 54 respectively. A camming surface 70 on the lower part of the bar 50, and camming surface 71 on the probe 51, when the upper section 41 is swung down about the annular corner 65, cams the bar 50 and probe 51 apart until the probe 51 clears the bar 50 and relaxes to latch at the surfaces 53 and 54 as shown in FIG. 1.

The method by which the bodies are formed and latched will be more apparent from a consideration of FIGS. 5 and 6, in which a number of bodies 21 in a web 72 comprising an upper metallic conveyor strip 73, a lower metallic conveyor strip 74, and vertical conjoining metallic strips 75 which join the upper and lower parallel strips 73 and 74. Between each adjacent conjoining strip 75 is a resilient body 21. From the lower strip integrally extend connections 57, 58, and 59, respectively, which themselves are entered into the body to provide the terminals 23, 24, and 25. In short, the terminals are arranged and the bodies, preferably of a resin based material, are molded about the terminals 23, 24, and 25. The upper section 41 and the upper part of the incomplete section 43 in the incipient body are made in one vertical portion or upstanding side section joined by an annular, concave inward, corner 65 of decreased thickness. Once the bodies 21 are formed, the members 30 may be appropriately placed on the posts 37. The bodies may then each be cut from the lower conveyor strip 74, bent or swung about the corner 65 until the camming surface 70 of each probe 51 cams the probe 51 over the camming surface 71 of the corresponding bar 50, and when released the latch is completed with the latching surfaces 53 and 54 joined. Registration apertures 76 on the upper strip 73 and apertures 77 on the lower strip 74 control the spacing of the conveyors as they are passed through automatic machinery for the forming of bodies 21, and the handling of the bodies after forming.

In operation of the embodiment of FIGS. 1, 2, and 3, when the nose is pressed down against the resilience of the body 21, particularly at the corner 65, the nose 44 presses on the front and back side of the post 37 and inward of the fulcrum 38. The contact or cylindrical element carried at the action end 35 of the spring is initially and normally in contact with the upper bar 50, which is an exposed part of the terminal 25. When the nose 44 presses on the member 30 inward of the fulcrum 38, the force exerted causes a couple or turning moment about the fulcrum at outer notch 38 on the post 37. The clockwise turning moment ultimately is sufficiently great, that it overcomes the force holding the spring 31 against the upper terminal or bar 50 and the spring 31 causes the action end 35 of the member 30 to snap down to make contact with the second exposed terminal at 49. As soon as the pressure of the nose 44 against the member 30 is released, the action end 35 of the member 30 returns to its initial position, to which it is urged by the action of the spring 31, with the cylindrical element 48 again in contact with the exposed bar 50. The action is illustrated by the schematic electrical diagram conjoining FIG. 1A in which the solid line indicates the connection in the normal condition of the switch, and the dotted line indicates the connection when the nose is depressed.

If it is desired to have a snap action switch in which the initial condition is with the cylindrical contact element 48 in contact with the lower exposed part 49 of third terminal 24, the initial condition is adjusted accordingly. As illustrated in FIG. 4, the outer notch 38 should be before the inner notch 80 wherein is lodged the tongue end 32. The end of the nose 44 should be applied outside of the post 37 and fulcrum 38. Otherwise the construction is substantially the same as for FIGS. 1-3. When the nose 44 in FIG. 4 is depressed against the surround 33 outside of and adjacent the fulcrum at the notch 38, a counterclockwise moment results about the fulcrum at notch 38. This moment causes the action end 35 of the member 30 to tend to move up and eventually to overcome the restraining force of its normal condition. The result is a snap action of contact 48 up to make contact with the bar 50 as the upper exposed portion of the terminal 25. On release the cylindrical element 48 snaps back to its initial condition. Naturally since the nose 44 in this construction avoids the post in any event, it may be made simply in a single piece, as indicated in FIG. 4, and no division is required.

This construction illustrated by FIG. 4 is another form of the invention, although the form used may possibly be dictated by the desire to use a particular initial electrical condition, such as the one illustrated in the schematic of FIG. 1*a*.

In making an incipient form 69 of the switch (see FIGS. 5 and 6) which may then be folded at the corner 65 to make either the switch of FIG. 1 or of FIG. 4, two parallel horizontal strips 73 and 74 are joined by strips 75. Accurately longitudinally spaced holes 76 and 77 in the respective upper and lower strips 73 and 74 respectively are used to step the strips to bring them to a molding station, where the mold is charged and incipient form 69 is molded between each adjacent pair of joining strips 75. The strips and molded forms may then be stepped to another station where the upper strip 73 is detached by cutting the strips 75, for example where they join the lower strip 74. Now the body may be stepped to another station where the exposed post 37 is notched as desired, depending on the form of the switch desired, that of FIG. 1 or FIG. 4. However, the post 37 may be pre-notched. At the next station the member 30 is attached to the post 37 and the spring 31 bent and fitted. At the next station the form 69 may be bent at the corner 65 so that the camming surfaces cam the sections 40 and 41 to latch the bar 50 and the probe 51. The remaining lower strip 74 may then be stepped to another station where the newly formed snap action switch may be separated from the lower strip 74 to leave the proper lengths of the connections 57, 58 and 59. This separation completes the construction of the switch.

From the foregoing description it is apparent that I have invented a new and useful snap action switch which may be extremely miniaturized. In one embodiment the dimensions of the body 21 left to right excluding the external connections was 0.275 inch, and top to bottom, excluding the external connections, was 0.250 inch, and the depth was only 0.090 inch. The stroke may be extremely short, such as less than 1/10th of an inch. Moreover, the snap switches of the invention are readily constructed, and operate repetitively and reliably. The construction and method of construction are novel and readily afford large volume production.

I claim

1. A miniature precision action switch comprising:

a unitary resilient insulating body configured in an incomplete loop, the resilience tending to open the loop and the body having a latch within the loop to retain its loop configuration; the loop comprising a complete cover section, a complete base section and a complete side section that circumscribe an inner loop area;

a first terminal imbedded in the body and extending into the inner loop area as an exposed post;

a metallic member having: a cut-out tongue having an end; a complete surround about the tongue; a longitudinal axis; a longitudinal end adjacent the tongue end to form a space therebetween; and another longitudinal end within the loop; the member being on and electrically connected to the post with the post inserted in the space between the tongue and the adjacent surround to bend the tongue to form a spring;

a nose extending from the cover section toward the base section and toward the post to form an incomplete side section of the loop;

second and third terminals imbedded in the body and having parts exposed on opposite sides of the other end of the member respectively;

wherein the other member end is normally connected to one of the second and third terminal exposed parts to complete an electrical circuit between the post and the one terminal, and when the nose is pressed against the surround adjacent the end of the tongue, the other end of the member is snapped to contact the exposed part of the other of the second and third terminals to complete an electrical circuit between the post and the other of the second and third terminals.

2. A switch as claimed in claim 1, the terminals being connected to terminal connections outside the body.

3. A switch as claimed in claim 1, the nose having two parts on opposite sides of the post.

4. A switch as claimed in claim 1, the post having a first notch outside said body with respect to the inner loop area, the surround fitting in the notch to afford a fulcrum for the metallic member.

5. A switch as claimed in claim 4, the surround adjacent the other member end having a normal position down and in contact with the exposed second terminal, the nose being opposite the surround outside the loop in the loop area with respect to the fulcrum, whereby the member other end is snapped up into contact with the exposed part of the third terminal when the nose is pressed against the surround.

6. A switch as claimed in claim 4, the post having a second notch inward of the post with respect to the loop and displaced from the first notch toward the lower section of the body in which the end of the tongue is lodged.

7. A switch as claimed in claim 4, the surround adjacent the tongue end having a normal position in contact with the exposed part of the third terminal, the nose being opposite the surround in the inner loop area with respect to the fulcrum, whereby the member other end is snapped down into contact with the exposed part of the second terminal when the nose is pressed against the surround.

8. A switch as claimed in claim 7, the nose having two parts on opposite sides of the post.

9. A switch as claimed in claim 8, the member being substantially planar, the post having an axis normal to the plane of the member, the member having at its other end a cylindrical contact element perpendicular to the longitudinal axis and parallel to the plane of the member.

10. A switch as claimed in claim 9, the third terminal exposed part serving also as part of the latch.

11. A switch as claimed in claim 1, the resilient body having a probe extending from the incomplete side section of the body toward the complete side section, and having a bar extending from the complete side section toward the incomplete side section, the probe and the bar latching with each other to form the latch.

12. A switch as claimed in claim 11, the member being substantially planar, and carrying at its other end a cylindrical contact element having an axis perpendicular to the longitudinal axis and parallel to the plane of the member.

13. A switch as claimed in claim 11, one of the bar and the probe having a camming surface to cause the the bar and probe, when the body is folded into its loop configuration, to establish an overlying relationship whereby the cover section is latched in place.

14. A switch as claimed in claim 13, the probe having the camming surface under the prove that latches with the bar as the body is resiliently folded into the loop.

15. A switch as claimed in claim 14, the exposed part of the third terminal in the inner loop area comprising the bar.

16. A switch as described in claim 15, the cover body section and the incomplete side section being held in configuration by the probe and bar in their latched conditions.

17. A switch as claimed in claim 16, there being a corner of the body between the cover body section and the complete side section, the corner having a reduced annular thickness concave internally toward the loop.

18. A switch as claimed in claim 16, further comprising three exposed connections exterior to the body and connected individually to the three terminals respectively.

19. A switch as claimed in claim 18, the three exposed connections being aligned.

20. An incipient switch form comprising:

a unitary integral body;

the body having a base section and an upstanding side section; the upstanding side section being joined to the base section at a corner and having a reduced thickness segment intermediate the length of the upstanding side section;

a first contact imbedded in the base section remote from the corner;

a second contact imbedded in the base section between the corner and the first contact;

a bar extending from a location on the upstanding side section between the corner and the fold segment and spaced from the base section;

the upstanding side section having, at an end portion remote from the corner and displaced from the fold segment, a probe extending therefrom the probe having a camming surface facing the bar, the remote end portion additionally having a nose facing the base section;

whereby the upstanding side section may be folded at the fold segment to bring the camming surface of the probe into engagement with the bar to latch the bar and probe together to retain the body in a loop position.

21. An incipient switch form as claimed in claim 20, the fold segment being annulus-like and concave to the inside of the loop.

22. In a snap action switch, a substantially planar metallic element having a cut-out tongue having a free terminal end, a complete surround having a first longitudinal end adjacent the end of the tongue, and a second longitudinal end;

a vertical conductive post, the metallic element being mounted on the post with the post inserted between the tongue end and the adjacent surround to bend the tongue into a spring with the tongue end against the post;

first and second conductive terminals oppositely spaced with respect to the second longitudinal end of the element;

a body having a nose aligned with the post and means for holding the terminals, the post, and the element in an initial position with the spring holding the second longitudinal end of the element against one of the first and second terminals in the initial position creating an initial connection between the post and the one terminal, whereby a force applied to the body displaces the nose against the surround adjacent the tongue end to displace the surround and snap the second longitudinal end from its initial position against the one terminal to a position against the other of the terminals, the second longitudinal end snapping to return to its initial position when the force is relaxed.

23. In a snap action switch as claimed in claim 22, the first terminal being located on the first side of the other end of the element, the nose, when displaced, pressing against the surround longitudinally between the post and the other element end, the initial connection being between the post and the first terminal.

24. In a snap action switch as claimed in claim 22, the second terminal being located on the second side of the other end of the element, the nose, when displaced, pressing against the surround on the other longitudinal side of the post from the other element end, the initial connection being between the post and the second terminal.

25. In a snap action switch as claimed in claim 22, the post having an outer side with a notch opposite the tongue end for retaining the surround.

26. In a snap action switch as claimed in claim 22, the post having an inner side with a notch for retaining the tongue end.

27. In a snap action switch as claimed in claim 22, the post having an outer side with a notch opposite the tongue end for retaining the surround, and having another side with another notch retaining the tongue end.

28. In a snap action switch as claimed in claim 27, the post having an end, and one notch being closer to the end than the other.

29. A miniature precision snap switch comprising:

an integral insulating body with a base section, an upstanding complete side section connected to said base section, and an upper section and with means for enabling the upper section to pivot in a plane through the sections with respect to the complete side section, first and second spaced terminals each having connections external to the body, the first terminal having a post internal to the body and the second terminal having a portion defining a contact surface internal to the body, movable conductive contact means having two ends, one said end being affixed to the post and the other end being a free end, said contact means additionally including a surround portion and a tongue portion for engaging the post, the tongue portion being stressed thereby to bias the free end to a first position and being movable to a second position, the free end engaging the contact surface in one of its two positions, the body additionally having a nose portion extending from the upper section parallel to and spaced from the upstanding complete side section for engaging the contact means, the nose means forcing the conductive contact means to the second position when the upper portion pivots toward the lower portion of the body.

30. A snap action switch as recited in claim 29 additionally comprising third terminal means having a connection external to the body and defining a second contact surface internal to the body, said first and second contact surfaces being located at the first and second positions of the movable conductive contact means.

31. A snap action switch as recited in claim 29 wherein the second terminal means includes a bar that is internal to the body and transverse to the complete side section and that terminates with a latching surface, the upper section having a probe means with a latching surface parallel to the bar latching surface, the bar and probe overlying each other at the latching surfaces thereby to maintain the upper section for positioning the nose proximate the movable conductive contact means.

* * * * *